US010864647B2

(12) United States Patent
Alvarez

(10) Patent No.: US 10,864,647 B2
(45) Date of Patent: Dec. 15, 2020

(54) ADJUSTABLE RAZOR AND METHOD OF USE

(71) Applicant: Reyna Alvarez, Raleigh, NC (US)

(72) Inventor: Reyna Alvarez, Raleigh, NC (US)

( * ) Notice: Subject to any disclaimer, the term of this patent is extended or adjusted under 35 U.S.C. 154(b) by 0 days.

(21) Appl. No.: 16/589,228

(22) Filed: Oct. 1, 2019

(65) Prior Publication Data

US 2020/0230836 A1 Jul. 23, 2020

Related U.S. Application Data

(60) Provisional application No. 62/795,327, filed on Jan. 22, 2019.

(51) Int. Cl.
*B26B 21/52* (2006.01)
*B26B 21/44* (2006.01)

(52) U.S. Cl.
CPC ..... *B26B 21/523* (2013.01); *B26B 21/446* (2013.01)

(58) Field of Classification Search
CPC ..... B26B 21/523; B26B 21/446
USPC ..... 30/526
See application file for complete search history.

(56) References Cited

U.S. PATENT DOCUMENTS 4,635,361 A 1/1987 DeMars
5,016,351 A * 5/1991 Drahus ..... B26B 21/446 30/41
5,167,069 A * 12/1992 Quinn ..... B26B 21/523 30/527
5,168,628 A * 12/1992 Mock ..... B05B 11/0005 30/125
5,402,697 A * 4/1995 Brooks ..... B26B 19/40 30/34.2
5,911,480 A 6/1999 Morgan
6,266,888 B1 * 7/2001 Zowaski ..... B26B 21/523 30/526
9,604,376 B2 * 3/2017 Sacks ..... B26B 21/523
2003/0177648 A1 * 9/2003 Zeiter ..... B26B 21/523 30/526
2003/0208914 A1 * 11/2003 Ehrlich ..... B26B 21/522 30/526
2004/0107585 A1 6/2004 Helmrich
2008/0110025 A1 * 5/2008 Bucalo ..... B26B 19/38 30/43.1
2009/0100679 A1 * 4/2009 Casciaro ..... B26B 21/165 30/34.05

(Continued)

FOREIGN PATENT DOCUMENTS

CA 2 443 881 * 4/2005

*Primary Examiner* — Hwei-Siu C Payer
(74) *Attorney, Agent, or Firm* — Boudwin Intellectual Property; Daniel Boudwin

(57) ABSTRACT

An adjustable elongated razor with shave cream dispenser, and a method of shaving that utilizes the adjustable elongated razor. The razor includes an elongated body that is telescopically adjustable and connected to a handle on a proximal end thereof and connected to a bracket on a distal end thereof. The bracket removably secures a shave razor therein. During use, a reservoir within the handle is filled with a shave cream, and the shave cream is dispensed by depressing a button on the handle. The shave cream is dispensed through an aperture on the distal end of the elongated body, where it comes into contact with an individual's skin and the shave razor for shaving the individual's skin.

11 Claims, 4 Drawing Sheets

(56) References Cited

U.S. PATENT DOCUMENTS

| | | | | |
|---|---|---|---|---|
| 2009/0205207 | A1* | 8/2009 | Rawle | B26B 21/4043 30/34.1 |
| 2011/0094114 | A1 | 4/2011 | Payne-Baggetta | |
| 2011/0146080 | A1* | 6/2011 | Pauw | B26B 21/446 30/41.5 |
| 2013/0019484 | A1 | 1/2013 | Allen et al. | |
| 2013/0152400 | A1* | 6/2013 | Nunez | B26B 21/22 30/47 |
| 2016/0136827 | A1* | 5/2016 | Gulledge | B26B 21/521 30/526 |
| 2017/0050327 | A1 | 2/2017 | Alam | |
| 2020/0230836 | A1* | 7/2020 | Alvarez | B26B 21/523 |

* cited by examiner

ADJUSTABLE RAZOR AND METHOD OF USE

CROSS REFERENCE TO RELATED APPLICATIONS

This application claims priority under 35 U.S.C. § 119(e) to U.S. Provisional Application No. 62/795,327 filed on Jan. 22, 2019. The above identified patent application is incorporated by reference herein in its entirety to provide continuity of disclosure.

BACKGROUND OF THE INVENTION

The present invention relates to an adjustable razor for shaving difficult-to-reach areas of an individual's body.

Many individuals shave their extremities, including their legs. However, this process may be difficult, particularly for individuals with injuries or disabilities. As a result, many of these individuals may forego shaving their extremities, and they may encounter difficulties that result therefrom.

Therefore, there is a need in the art for an adjustable razor that enables the individual to easily shave difficult-to-reach areas of his or her body, including but not limited to arms, legs, feet, and the like. The present invention addresses this unmet need.

Devices have been disclosed in the art that relate to adjustable razors. These include devices that have been patented and published in patent application publications. These devices are often unsatisfactory and require a multitude of steps for operation. In view of the devices disclosed in the art, it is submitted that there is a need in the art for an improvement to existing adjustable razors. In view of the present disclosure, it is submitted that the present invention substantially diverges in structural and functional elements from devices in the art, and substantially fulfills an unmet need.

SUMMARY OF THE INVENTION

In view of the disadvantages inherent in the known types of adjustable razors in the art, the present invention provides a new and improved adjustable razor, wherein the same can be utilized for enabling individuals to shave difficult-to-reach areas of their bodies, including but not limited to arms, legs, backs, and the like.

It is therefore an object of the present invention to provide an adjustable razor for customized shaving, including storage and dispensing of shave cream for shaving.

In one aspect, the invention provides an adjustable razor, comprising: an arcuate telescopic elongated body having a hollow interior therein; a handle disposed on a proximal end of the arcuate telescopic elongated body; a reservoir disposed within the handle and in fluid communication with the hollow interior of the arcuate telescopic elongated body; and a bracket disposed on a distal end of the arcuate telescopic elongated body, such that the bracket is configured to removably secure a shave razor therein. An aperture on the distal end of the arcuate telescopic elongated body is included such that the aperture is in fluid communication with the hollow interior of the arcuate telescopic elongated body. In various embodiments, a length of the arcuate telescopic elongated body is adjustable.

In some embodiments, the arcuate telescopic elongated body is cylindrical, and a diameter of the handle is larger than a diameter of the arcuate telescopic elongated body. In various embodiments, a diameter of the cylindrical arcuate telescopic elongated body tapers from the proximal end to the distal end.

In some embodiments, upon depression of a dispenser button disposed on the handle, the reservoir is in fluid communication with the hollow interior of the arcuate telescopic elongated body and the aperture on the distal end of the arcuate telescopic elongated body. In this manner, a fluid, such as a shave cream or a shave gel, disposed within the handle is able to be dispensed out of the aperture on the distal end of the arcuate telescopic elongated body.

In some embodiments, an angle of the shave razor relative to the arcuate telescopic elongated body is adjustable. In this manner, the shave razor may bend as a result of forces applied to the shave razor during use. In this manner, the method of shaving using the device of the present invention may be safer and may result in a lower probability of cuts or nicks in the skin during use.

In some embodiments, the reservoir is accessible by removal of a threaded cap from the handle. In various embodiments, the threaded cap includes a male threading thereon, and the proximal end of the handle includes a female threading thereon. In this manner, the threading of the threaded cap is able to be screwed into the threading of the handle to secure the reservoir in a closed configuration, and may be screwed out of the threading of the handle to expose the reservoir in an open configuration. The closed configuration is generally used during a shave session, and the open configuration may be used between shave sessions, for example, to refill the reservoir with shave cream or shave gel, or to clean the reservoir and hollow interior of the arcuate telescopic elongated body.

In some embodiments, the reservoir is configured to removably hold a shave cream therein and release the shave cream into the hollow interior and out of the aperture upon depression of a dispenser button disposed on the handle. The dispenser button, when depressed, fluidly connects the reservoir with the hollow interior, which allows the shave cream or shave gel therein to travel down a length of the arcuate telescopic elongated body and out of the aperture for use.

In some embodiments, the shave razor is releasable from the bracket upon depression of a release button disposed on the distal end of the arcuate telescopic elongated body. The release button, when depressed, disconnects the shave razor from the bracket, which allows an individual to replace the shave razor with a new shave razor, which may be needed from time to time during use of the device of the present invention.

In some embodiments, the release button is positioned on an upper surface of the distal end of the arcuate telescopic elongated body, and the aperture is positioned on the spout adjacent to a lower surface of the arcuate telescopic elongated body. In some embodiments it may be advantageous to position the aperture near a plurality of blades of the razor, and in this manner, upon application of the shave cream or shave gel to an area of the body of the individual, the area is readily shaved using the razor adjacent thereto. In such embodiments, it may be advantageous to include the release button on the upper surface of the distal end of the arcuate telescopic elongated body, such that the release button may be easily depressed by a digit of a hand of the individual, such as a thumb, when grasping the arcuate telescopic elongated body.

In another aspect, the invention provides a method of shaving that utilizes an adjustable razor of the present invention. The method may comprise one or more of: filling a reservoir of the adjustable razor with a shaving liquid; attaching a shave razor to a bracket of the adjustable razor; adjusting a length of an arcuate telescopic elongated body of the adjustable razor; depressing a dispenser button of the adjustable razor to dispense the shaving liquid out of an aperture of the adjustable razor; shaving a portion of a body of an individual; removing the shave razor from the bracket; removing a cap from a handle of the adjustable razor; and/or rinsing a reservoir disposed within the handle of the adjustable razor. Generally, in embodiments of the method in which access to the reservoir is needed, the individual may need to remove the cap from the handle. In embodiments of the method in which the shave razor needs replacement, the individual may need to remove the shave razor from the bracket. In this manner, the adjustable razor is easily understood and used by the individual, as would be understood by a person having ordinary skill in the art.

Another object of the present invention is to provide an adjustable razor that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
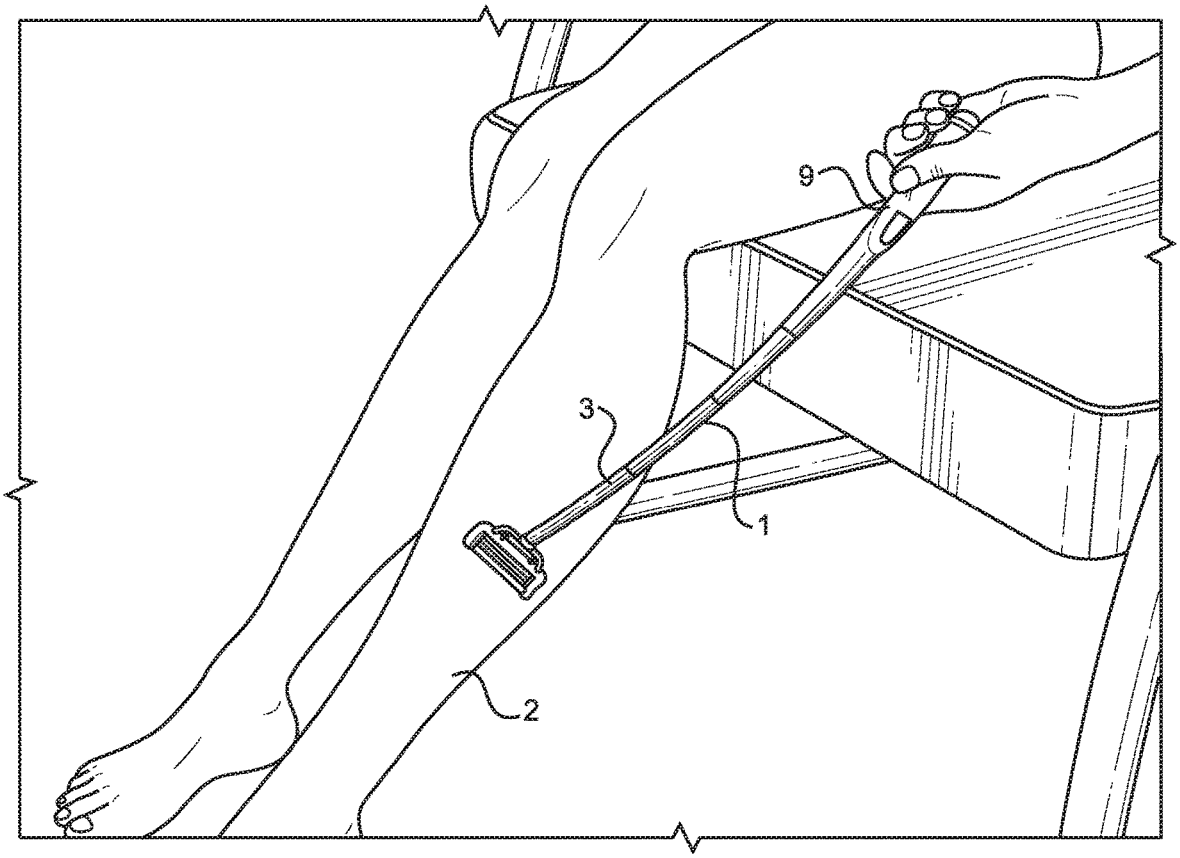
FIG. 1 depicts a perspective view of an exemplary adjustable razor of the present invention, in use as part of a method of shaving using the adjustable razor.

Reference is made herein to the attached drawings. Like reference numerals are used throughout the drawings to depict like or similar elements of the invention. The figures are intended for representative purposes only and should not be considered limiting in any respect.

Reference is now made to the drawings, which depict one or more exemplary embodiments of the invention.

Referring now to FIG. 1, there is depicted a perspective view of an exemplary adjustable razor of the present invention, in use as part of a method of shaving using the adjustable razor. In the shown embodiment, an adjustable razor 1 includes an arcuate telescopic elongated body 3, with a handle 9 on a proximal end of the arcuate telescopic elongated body 3. The arcuate telescopic elongated body 3 includes one or more telescoping elements thereon, such as cylinders that nest within each other, to enable the shaving individual to adjust the length of the arcuate telescopic elongated body 3 according to need. During use, the individual grasps the handle 9 and applies a mild to moderate force to a portion 2 of the individual's body in need of shaving.

Figure 2:
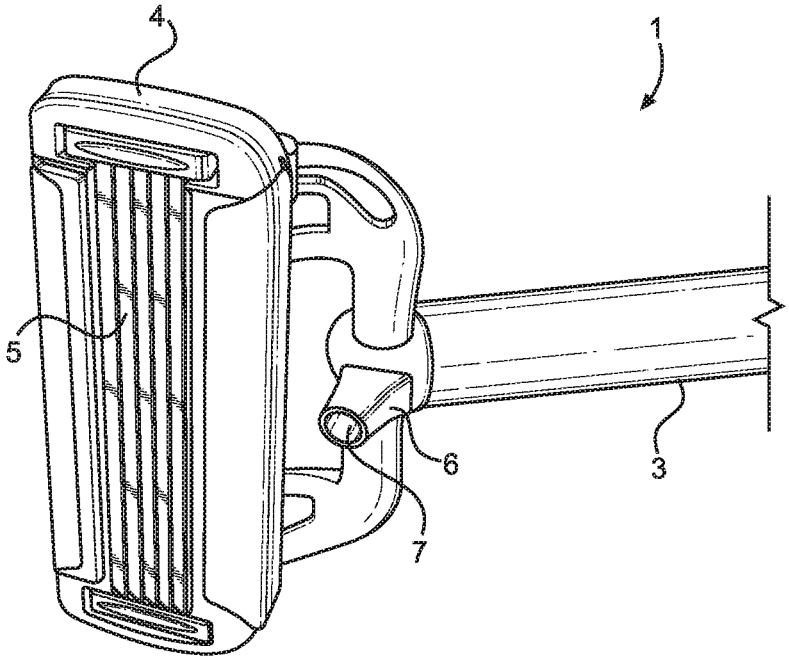
FIG. 2 depicts a perspective view of a shave razor reversibly attached to a bracket of a distal end of an arcuate telescopic elongated body of the adjustable razor, and an aperture adjacent thereto.

Referring now to FIG. 2, there is depicted a perspective view of a shave razor attached to a bracket of a distal end of an arcuate telescopic elongated body of the adjustable razor in a reversible manner, and an aperture adjacent thereto. In the shown embodiment, a shave razor 4, having a plurality of razor blades 5 thereon, is attached to a bracket of a distal end of the arcuate telescopic elongated body 3 disposed on the adjustable razor 1. In the shown embodiment, a small spout 6 extends downward from the bracket adjacent to a lower portion of the distal end of the arcuate telescopic elongated body 3, and includes an aperture 7 positioned on an end thereof. The aperture 7 is fluidly connected to a hollow interior of the arcuate telescopic elongated body 3, and in this manner, upon depression of a dispenser button of the adjustable razor 1, a shave solution, such as a shave cream or a shave gel, is dispensed out of the aperture 7 for application to the portion of the individual's body and/or the plurality of blades 5 of the shave razor 4. In this manner, the shaving individual may easily apply the shave solution to their body and shave, in a continuous activity that requires minimal effort.

Figure 3:
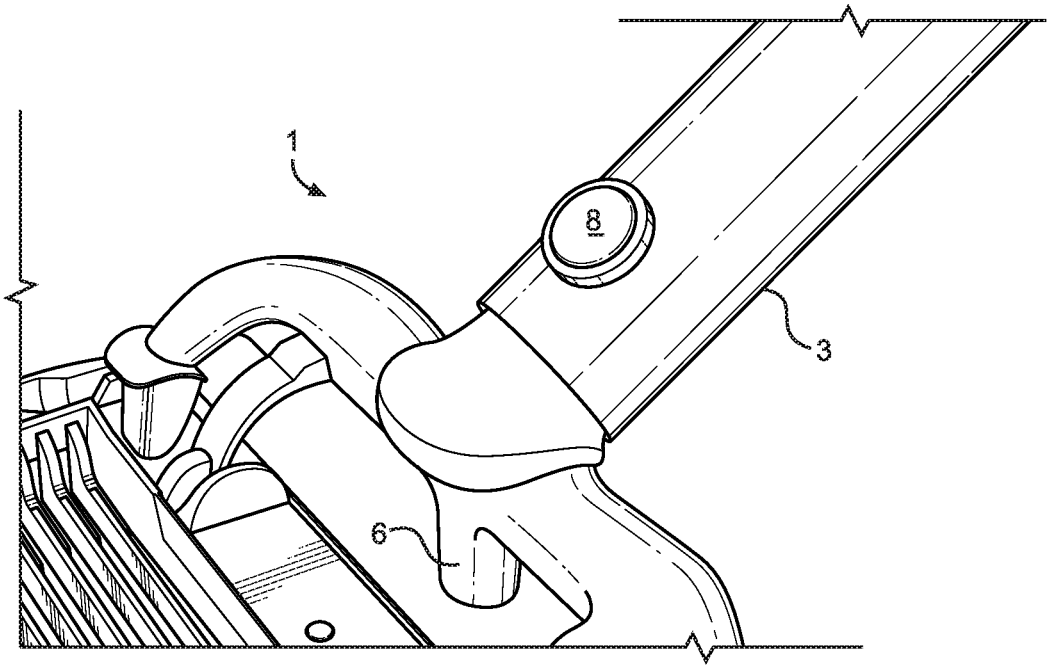
FIG. 3 depicts a perspective view of the distal end of the arcuate telescopic elongated body of the adjustable razor, with a release button disposed thereon.

Referring now to FIG. 3, there is depicted a perspective view of the distal end of the arcuate telescopic elongated body of the adjustable razor, with a release button disposed thereon. In the shown embodiment, a release button 8 is positioned on an upper surface of the distal end of the arcuate telescopic elongated body 3 of the adjustable razor 1. In such embodiment, it may be advantageous to include the release button 8 on the upper surface of the distal end of the arcuate telescopic elongated body 3, such that the release button 8 may be easily depressed by a digit of a hand of the individual, such as a thumb, when grasping the arcuate telescopic elongated body 3. In the shown embodiment, the aperture, on the end of the small spout 6, is positioned adjacent to a lower surface of the arcuate telescopic elongated body 3. In such embodiments it may be advantageous to position the aperture near the plurality of blades of the razor, and in this manner, upon application of the shave cream or shave gel to the area of the body of the individual, the area is readily shaved using the razor adjacent thereto. In this manner, ease of use of the present invention is maximized.

Figure 4:
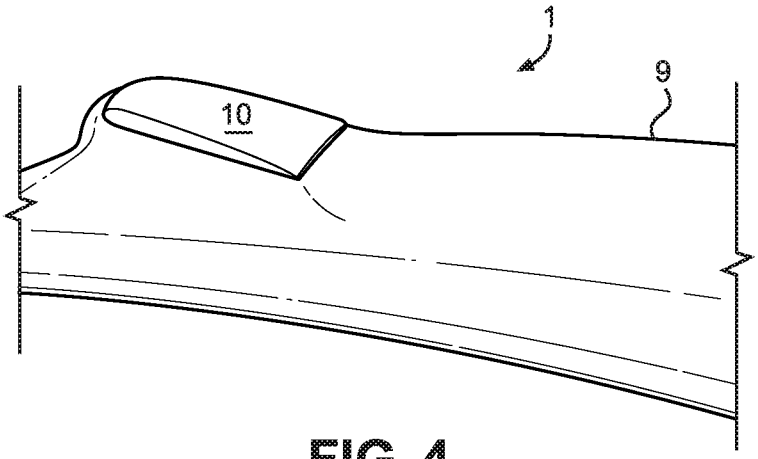
FIG. 4 depicts a perspective view of a handle of the adjustable razor, with a dispenser button disposed thereon.

Referring now to FIG. 4, there is depicted a perspective view of a handle of the adjustable razor, with a dispenser button disposed thereon. In the shown embodiment, a dispenser button 10 is positioned on the handle 9 of the adjustable razor 1, and is on an upper surface of the handle 9. In this manner, the dispenser button 10 may be easily depressed by the shaving individual to dispense the shave solution from a reservoir within the handle through the hollow interior of the arcuated telescopic elongated body and out of the aperture for application to the portion of the individual's body for shaving. In this manner, an individual can operate the shave cream dispenser when the adjustable razor is in an extended configuration as well as when the adjustable razor is in a retracted configuration. Generally, in the extended configuration (see FIG. 1) the adjustable razor is longer than it is in the retracted configuration. This may be achieved by a telescopic mechanism of the arcuate telescopic elongated body 3.

Figure 5:
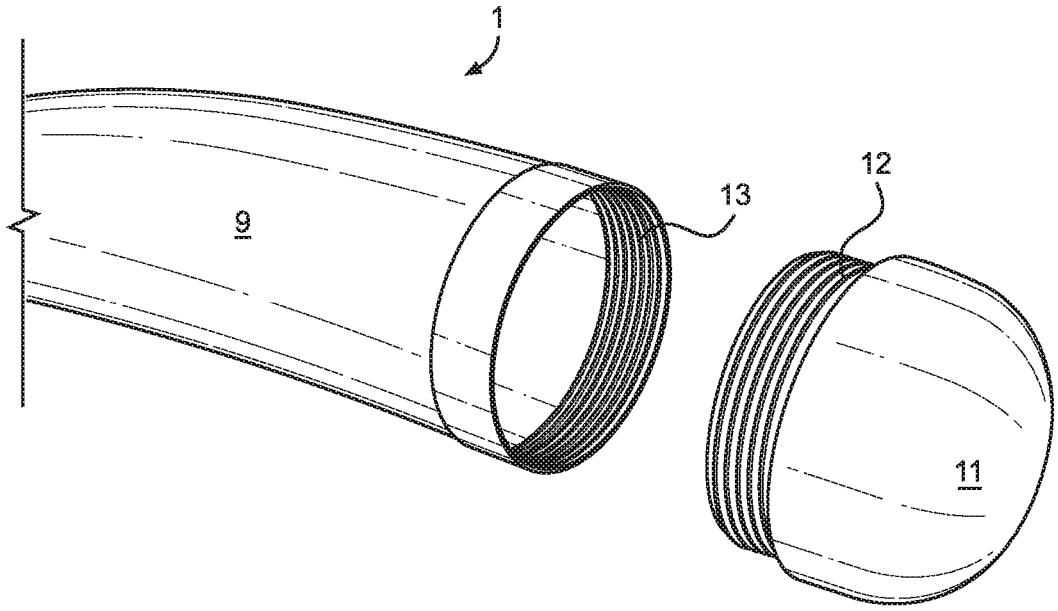
FIG. 5 depicts a perspective view of a threaded cap removed from the handle of the adjustable razor, revealing a reservoir therein.

Referring now to FIG. 5, there is depicted a perspective view of a threaded cap removed from the handle of the adjustable razor, revealing a reservoir therein. In the shown embodiment, the threaded cap 11 includes a male threading 12 thereon, and the proximal end of the handle 9 includes a female threading 13 thereon. In this manner, the threading 12 of the threaded cap 11 is able to be screwed into the threading of the handle 9 to secure the reservoir in a closed configuration, and may be screwed out of the threading of the proximal end of the handle 9 to expose the reservoir in an open configuration. Generally, the closed configuration is used during a shave session, and the open configuration may be used between shave sessions, for example, to refill the reservoir with shave cream or shave gel, or to clean the reservoir and hollow interior of the arcuate telescopic elongated body. In this manner, the adjustable razor 1 is reusable and may be easily maintained between uses.

Generally, the method comprises filling a reservoir of the adjustable razor with a shaving liquid, such as a shaving cream or gel; attaching a shave razor to a bracket of the adjustable razor; depressing a dispenser button of the adjustable razor; and shaving a portion of skin of an individual. In further embodiments, the method may comprise removing the shave razor from the bracket, or performing cleaning or maintenance activities relating to the adjustable razor, which may require removal of a cap from a handle of the adjustable razor and rinsing a reservoir or other interior cavity of the adjustable razor with a cleaning liquid, such as water, or a cleaning solution, as needed. In various embodiments, the method of shaving further comprises adjusting a length of an arcuate telescopic elongated body of the adjustable razor, such that the individual performing the method is able to reach difficult-to-reach areas of a body, including but not limited to an arm, a leg, a back, and the like. In this manner, the present invention provides improved safety and convenience to the shaving individual, who may experience difficulty shaving with ordinary shave razors.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. An adjustable razor, comprising:

an arcuate telescopic elongated body having a hollow interior therein;

a handle disposed on a proximal end of the arcuate telescopic elongated body;

a reservoir disposed within the handle and in fluid communication with the hollow interior of the arcuate telescopic elongated body;

a bracket disposed on a distal end of the arcuate telescopic elongated body, wherein the bracket is configured to removably secure a shave razor thereon;

an aperture positioned on a spout which extends directly from the bracket and is adjacent to a lower surface of the distal end of the arcuate telescopic elongated body, wherein the aperture is in fluid communication with the hollow interior of the arcuate telescopic elongated body;

the spout directing the aperture to a position beneath the shave razor;

the shave razor being releasable from the bracket upon depression of a release button disposed on an upper surface of the distal end of the arcuate telescopic elongated body;

wherein a length of the arcuate telescopic elongated body is adjustable via a plurality of telescoping elements.

2. The adjustable razor of claim 1, wherein the arcuate telescopic elongated body is cylindrical, wherein a diameter of the handle is larger than a diameter of the arcuate telescopic elongated body.

3. The adjustable razor of claim 1, further comprising a dispenser button disposed on the handle, the reservoir being in fluid communication with the hollow interior of the arcuate telescopic elongated body and with the aperture adjacent to the distal end of the arcuate telescopic elongated body.

4. The adjustable razor of claim 1, wherein an angle of the shave razor relative to the arcuate telescopic elongated body is adjustable.

5. The adjustable razor of claim 1, further comprising a threaded cap removable from the handle to access the reservoir.

6. The adjustable razor of claim 5, further comprising a dispenser button disposed on the handle for dispensing a shave cream in the reservoir into the hollow interior and out of the aperture upon depressing the dispenser button.

7. The adjustable razor of claim 1, wherein the aperture is positioned on the spout and is adjacent to the lower surface of the distal end of the arcuate telescopic elongated body.

8. A method of shaving that utilizes an adjustable razor, comprising:

providing an arcuate telescopic elongated body including a hollow interior therein;

providing a handle disposed on a proximal end of the arcuate telescopic elongated body and having a reservoir within the handle;

filling the reservoir with a shaving liquid;

attaching a shave razor to a bracket disposed on a distal end of the arcuate telescopic elongated body;

adjusting a length of the arcuate telescopic elongated body disposed on a distal end of the arcuate telescopic elongated body via the extension or retraction of a plurality of telescoping elements;

depressing a dispenser button on the handle to dispense the shaving liquid in the reservoir into the hollow interior and out of an aperture disposed on a spout extending directly from the bracket and adjacent to a lower surface of the distal end of the arcuate telescopic elongated body; and shaving a portion of a body of an individual with the shave razor.

9. The method of claim 8, further comprising: removing the shave razor from the bracket.

10. The method of claim 8, further comprising:

removing a cap from the handle before filling the reservoir with the shaving liquid;

replacing the cap onto the handle after filling the reservoir with the shaving liquid.

11. The method of claim 8, further comprising: cleaning the reservoir.

* * * * *